United States Patent [19]

Reiner et al.

[11] 4,157,633

[45] Jun. 12, 1979

[54] DOLL AND DEVICE APPARENTLY SUPERPOSING AN OBJECT ON DOLL'S REFLECTED IMAGE

[75] Inventors: Lawrence Reiner, Woodbury, N.Y.
Michael Hennig, Fort Lee, N.J.

[73] Assignee: Mego Corp., New York, N.Y.

[21] Appl. No.: 757,662

[22] Filed: Jan. 7, 1977

[51] Int. Cl.[2] ..... A63H 33/22; F21P 5/02

[52] U.S. Cl. ..... 46/116; 35/58; 40/219; 272/8 M; 272/8.5; 353/28

[58] Field of Search ..... 272/8 D, 8 M, 8.5; 35/58, 59; 40/28 B, 219; 46/116, 117, 118, 137, 140; 350/291, 174; 353/28

[56] References Cited

U.S. PATENT DOCUMENTS

| | | | |
|---|---|---|---|
| 1,822,808 | 9/1931 | Gordon | 35/58 |
| 2,075,198 | 3/1937 | Henye et al. | 35/59 |
| 3,507,570 | 4/1970 | Bourdier et al. | 353/28 |
| 3,729,839 | 5/1973 | Bourdier | 35/58 |

FOREIGN PATENT DOCUMENTS

| | | | |
|---|---|---|---|
| 800933 | 12/1950 | Fed. Rep. of Germany | 35/58 |

*Primary Examiner*—F. Barry Shay

*Attorney, Agent, or Firm*—Bertram Frank

[57] ABSTRACT

A doll with a simulated identity or plurality of identities. The simulation is attained by providing a transparent panel which is both light transmissive and light reflective and which is viewed by the child playing with the doll, which doll is mounted in front of the transparent panel. The transparent panel defines the front of an enclosure so that the movable panel, when in position, is generally parallel to and spaced from the transparent panel. The movable panel bears a recognizable portion of the identity desired. The balance of the surface of the movable panel is light absorptive, and the balance of the interior of the enclosure is also light absorptive. The doll is placed in front of the transparent panel and spaced therefrom by a distance generally equal to the distance between the two panels, so that the image of the doll reflected from the transparent panel appears to be coincident with the identity portion of the movable panel within the enclosure. In a preferred embodiment, the doll is rotatably mounted on a pedestal so that it can be turned alternately for front and back views, with corresponding front and back identity portions being provided on the movable panel, which moves linearly across the back of the enclosure in conjunction with the turning of the doll.

11 Claims, 13 Drawing Figures

DOLL AND DEVICE APPARENTLY SUPERPOSING AN OBJECT ON DOLL'S REFLECTED IMAGE

BACKGROUND OF THE INVENTION

1. Field of the Invention

The invention relates to the simulation of the appearance, and hence of the identity, of a doll.

2. Description of the Prior Art

Simulation of alternative identities of a doll provides much amusement and enjoyment for children, especially if the child is an only child and has no one else to play with. The most common expedient to accomplish alternative identities is to provide actual alternative sets of garb or clothing for a doll, however this necessitates costly and bulky extra items of manufacture, and also necessitates the laborious effort of undressing and dressing the doll. The sets of doll clothing tend to get torn during play or to be lost by the child so that the useful life of the clothing is limited. However, in the prior art, dolls have been made and sold which come complete with several alternative sets of actual doll clothing, each set of clothing differing from the others so that simulation of a specific identity is accomplished by dressing the doll in a particular set of clothing.

Other expedients of minor significance entail the provision of a mask or plurality of masks for the doll's head. Typical prior art of this nature includes U.S. Pat. Nos. 3,811,220; 1,926,139; 1,566,801 and 1,059,178.

The provision of amusing appurtenances for usage in conjunction with a doll has been practiced. For example, a toy musical cradle for usage with a doll is described in U.S. Pat. No. 3,988,856.

SUMMARY OF THE INVENTION

1. Purposes of the Invention

It is an object of the present invention to provide a doll with a simulated identity.

Another object is to provide a doll with a simulated plurality of identities.

An additional object is to simulate the appearance of a costume, garb or clothing or other identity portion of a doll.

A further object is to provide the illusion of one or a plurality of alternative garments or costumes on a doll without actually furnishing such garments.

Still another object is to enable a child to view a doll with simulated identity portion typically consisting of a costume, garb or clothing, alternatively from the front and back.

Still a further object is to provide an inexpensive toy for the amusement of children, which toy simulates a doll with interchangeable identities.

These and other objects and advantages of the present invention will become evident from the description which follows.

2. Brief Description of the Invention

In the present invention, the illusion of a simulated identity of a doll is accomplished by providing two coincident images for viewing by a child. These images coincide in the view of the child because of specific spacings and configurations of several of the elements of the device. What is done is to provide a reflected image of all or a selected portion of a doll, which appears to be coincident with a recognizable identity portion of a doll identity provided on a movable panel which is spaced such that it is viewed through a transparent panel. Thus the simulation or illusion that the doll consists of a recognizable person such as a fictional character, occupational character, etc. is attained.

The transparent panel is both light transmissive and light reflective, and is typically composed of glass or of a sheet of clear plastic such as cellulose acetate, polyvinyl chloride, polyethylene, polypropylene, acrylic resin, ureaformaldehyde resin, nylon or the like. The transparent panel defines the front of an enclosure and the doll is mounted in front of the transparent panel. A movable panel bearing at least one recognizable portion of the identity of a doll, e.g. a picture of a garment or costume such as a distinctive dress associated with a known fictional character, is passed into the rear of the enclosure. The balance of the movable panel is light-absorptive, e.g. black, and the balance of the interior of the enclosure is also light-absorptive, e.g. preferably black. The movable panel is passed into the rear of the enclosure in such a manner that the movable panel is disposed generally parallel to and spaced from the transparent panel, i.e. the movable panel is passed into the rear of the enclosure. The doll is placed in front of the transparent panel and is spaced therefrom by a distance substantially equal to the distance between the transparent panel and the movable panel, so that the image of the doll reflected from the transparent panel appears to be coincident with the identity portion of the movable panel within the enclosure.

In a preferred embodiment, the arms, legs and body of the doll are provided with a light-absorptive surface, so that only the head, hands and feet of the doll are reflected from the transparent panel. In this way, when the movable panel bears a representation of a full-length garment such as a dress, a very effective simulation that the doll is wearing the garment is attained. As mentioned supra, the light-absorptive surface in most instances will be black, and in practice and to provide more enhanced simulation, the light-absorptive surface may be attained by dressing the doll in a dark-colored full-length leotard which of course is preferably black.

The movable panel preferably bears two side-by-side or vertically aligned recognizable portions of the identity of the doll, e.g. the respective front and back views of a distinctive garment. In other words, one recognizable identity portion typically relates to the front of the doll and the other recognizable identity portion relates to the back of the doll. In this case the doll will be turnable about a central longitudinal axis, in conjunction with linear motion of the movable panel parallel to the transparent panel, so that the reflected image of the doll together with a corresponding recognizable identity portion may alternately appear to be viewed in the enclosure in simulated front and back views. The longitudinal axis will be understood to coincide with the height of the doll.

In most instances the doll, the transparent panel and the movable panel will be vertically oriented, and the recognizable identity portion will be a garment, a costume, or an article of clothing, e.g. a dress. Some of the many other possible recognizable identity portions feasible for usage in the invention are mentioned infra.

In general, the doll may be provided with a simulated plurality of identities by providing a plurality of juxtaposed recognizable portions of the identity of a doll on the movable panel; typically the movable panel will bear two recognizable portions of the identity of the doll, with one recognizable identity portion relating to one portion of the doll and the other recognizable identity portion relating to another portion of the doll. Suitable means will be provided to turn the doll in conjunction with linear motion of the movable panel parallel to the transparent panel. Each turning of the doll to an alternate position, in conjunction with linear motion of the movable panel, causes the respective reflected image of a selected portion of the doll, together with a corresponding recognizable identity portion, to appear to be viewed in the enclosure in a simulated coincident image. As mentioned supra, in the case of two recognizable identity portions on the movable panel, typically one portion will relate to the front of the doll and the other portion will relate to the back of the doll, with the doll being turned by suitable means about a central longitudinal axis, so that the reflected image of the doll together with a corresponding recognizable identity portion may alternately be viewed in the enclosure in simulated front and back views.

A unique configuration of structure and elements is preferably provided to turn the doll about a central longitudinal axis in conjunction with linear motion of the movable panel parallel to the transparent panel. The structure includes specific elements which serve to enable a child to appropriately manipulate the device. The elements include a hollow planar platform, and a centrally pivoted substantially circular planar driving member disposed within and in parallel with the platform. The platform has a semi-circular section an a rectangular section, with the diameter of the semi-circular section being of about the same length as, and joined to, a side of the rectangular section. The driving member is pivotally mounted within the platform by a central axle, which central axle is disposed generally at the center of the diameter of the semi-circular section of the platform. In general, this diameter center or middle will be essentially coincident with the center or middle of that side of the rectangular section of the platform which is joined to the semi-circular section of the platform. The semi-circular section of the platform is provided with an arcuate slit. A handle extends from the perimeter of the driving member through the arcuate slit, so that the circular driving member within the platform may be turned, i.e. partially rotated, typically by about 180 degrees, about the central axle by manipulation of the lever by a child playing with the toy.

A pedestal or other suitable means is provided to mount the doll in front of the transparent panel. The pedestal will preferably be provided with at least one clamp, or usually two clamps, to hold the leg of the doll. The pedestal or the like is mounted on the semi-circular section of the platform by providing a central rotation axle for the pedestal, with the central rotation axle extending through the top of the platform and into the hollow interior of the platform. A circular pedestal rotation gearing means is coaxially attached to the central rotation axle within the platform. Within the context of the present invention, gearing or gears will be understood to encompass and include frictional contact surfaces or the like.

The circular driving member mentioned supra is provided with an inner arcuate gearing and an outer perimetral arcuate gearing. The inner arcuate gearing is disposed opposite to the outer perimetral arcuate gearing. This inner arcuate gearing of the circular driving member is geared to the pedestal rotation gearing means, so that manipulation of the lever causes the pedestal to turn, i.e. partially rotate, about its central rotation axle.

A pinion gear is also provided in the preferred configuration. The outer perimetral arcuate gearing of the circular driving member is geared to outer perimetral gear teeth of the pinion gear, so that manipulation of the lever causes the pinion gear to rotate about its fixed central axis. The pinion gear also has an inner gearing which cooperates with a linear rack. The rack is disposed in the rear of the rectangular section of the platform, and the rack is below and is attached to the means, such as a bracket or frame, on which the movable panel is mounted, such bracket or frame means comprising the means to pass the movable panel into the rear of the enclosure. The inner gearing of the pinion gear is geared to the rack, so that rotation of the pinion gear causes the rack to move linearly under the rear of the enclosure, and thereby to pass the bracket or frame and associated movable panel across the rear of the enclosure, concomitantly with the turning or partial rotation of the pedestal as mentioned supra.

In a preferred embodiment of this configuration, a movable light-absorptive panel is also provided. This light-absorptive panel extends upwards and through a curved slit in the rear of the rectangular section of the platform, from a lower attachment to the circular driving member. This lower attachment is preferably adjacent to the outer perimetral arcuate gearing of the circular driving member. In this manner, manipulation of the lever causes the light-absorptive panel to pass across the rear of the enclosure and in front of the movable panel when the doll is concomitantly partially turned or rotated, so that the movable panel is only visible when the doll has been completely turned to an alternate position. In other words, the light-absorptive panel serves to block any view of the movable panel while it is only partially displaced and is between the specific positions at which alternate recognizable identity portions are completely visible to the child.

The light-absorptive panel is preferably at least slightly curved, and as was the case with other light-absorptive components or areas mentioned supra, the light-absorptive panel is preferably black.

Finally, as will appear infra in the description of the Figures, the enclosure mentioned supra, in a preferred embodiment, will be a simulated portion of a toy dressing room, i.e. a side portion of a toy dressing room typically where a full-length mirror would be mounted in a real dressing room, so that a child can derive much amusement and pleasure from imagining that he or she is dressing the doll in a manner comparable to real life, i.e. when a person alternately dons alternate garments, costumes or outfits in dressing for an occasion, and views himself or herself before a full-length mirror in each outfit to decide which one of alternate garments would be most suitable for the occasion.

The doll of the present invention provides several salient advantages. A doll is provided with a simulated identity or simulated plurality of identities in a simple yet effective manner, and the toy thus provides much amusement and enjoyment for children playing with the doll. The interchangeable identities are obtained in an inexpensive manner which does not necessitate the provision of actual sets of clothing, costumes or garments for the doll. The doll in a preferred embodiment may be turned on a pedestal or the like, together with linear motion of the movable panel, so that the doll may be viewed alternately from the front and back. A great many alternative identities or identity portions are provided in an inexpensive manner simply by providing alternative movable panels, which are of low cost, being fabricated from carboard or paperboard with the identity portions printed thereon. The toy is light in weight and easy to handle, and thus may even be enjoyed by a very young child, even by pre-school age children of 3 to 5 years of age. The toy may be enjoyed by one or several children, and is especially attractive to an only child who has no other children to play with, since the illusion of personalities or personages known to the child from television or the like is attained, and thus the child can readily identify with the toy.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENT

Figures 1, 2:
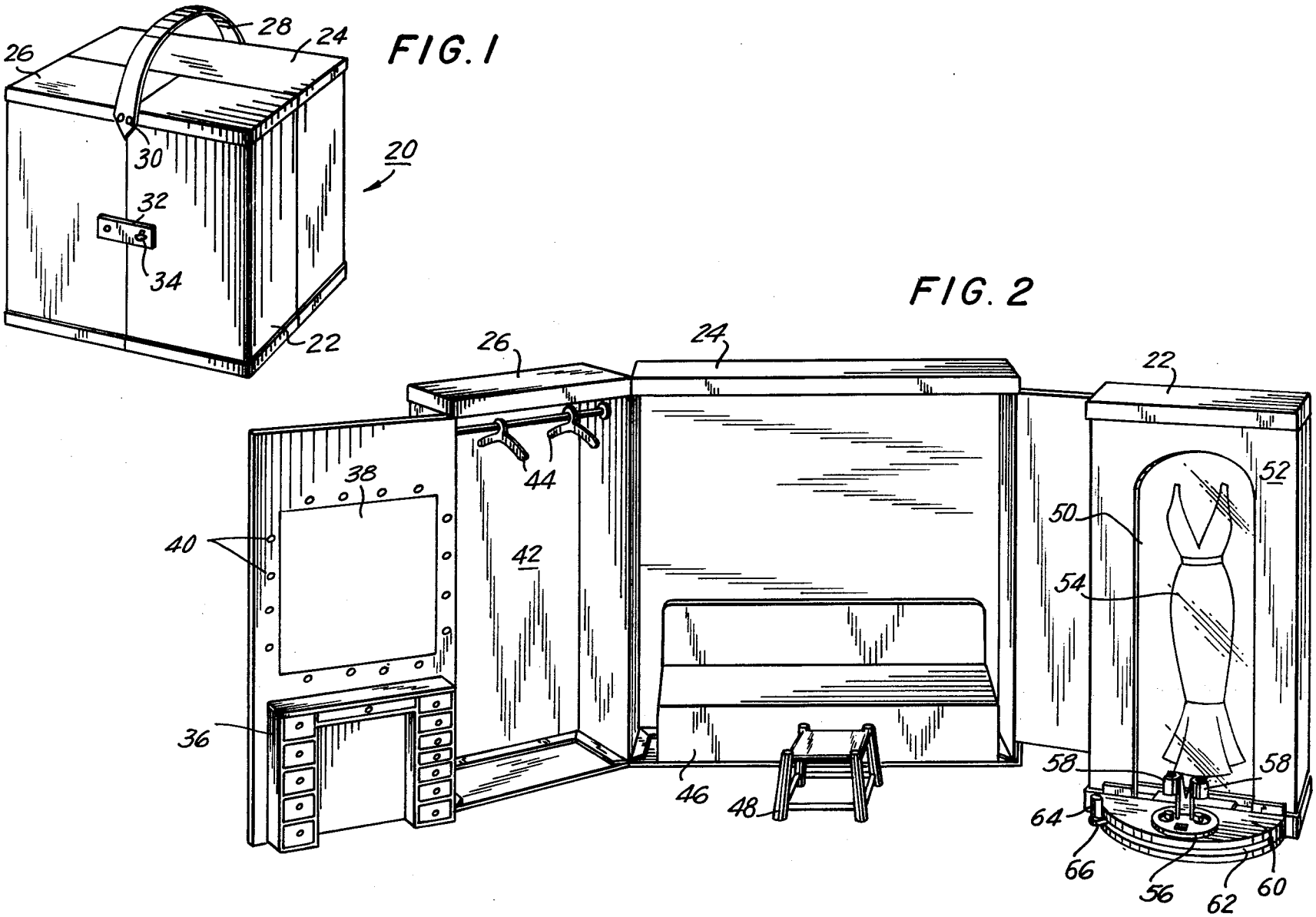
FIG. 1 is a perspective view of a unitary toy dressing room embodiment of the invention in closed condition, i.e. with the several sections folded together and secured for easy handling or storage.
FIG. 2 shows the toy dressing room in opened condition and ready to be played with by a child.

Referring now to FIG. 1, a toy dressing room 20 is shown in closed condition suitable for transport by a child or as sold. The toy dressing room 20 consists of three sections 22, 24 and 26, of which section 22 is an enclosure in accordance with the present invention. The sections 22, 24 and 26 when folded together as in FIG. 1 form a rectangular parallelepiped parcel which is held or carried by a strap 28, the ends of which are attached to the middle of opposite sides of the unit 20 by removable clips 30. A latch strap 32 holds the two sections 22 and 26 together; the strap 32 is secured in place by a clasp 34.

FIG. 2 shows the overall toy dressing room in fully opened condition and ready to be played with by a child. The simulation of a real dressing room such as a boudoir is facilitated by the provision of the usual dressing room appurtenances in simulation in the toy, i.e. a toy dresser 36 complete with drawers, a toy mirror 38 complete with simulated lights 40, a toy clothes closet 42 complete with toy clothes hangers 44, a simulation of a bed or couch 46, a real toy stool 48, etc.

The present invention specifically pertains to the enclosure section 22 as shown in open form ready to be played with in FIG. 2. A transparent panel 50 extends across the front of enclosure 22, and is defined by the front panel 52 of enclosure 22. The panel 50 is typically composed of one of the materials mentioned supra, and is both light-transmissive and light-reflective. Thus, a recognizable identity portion 54, specifically the front of a dress, is visible through panel 50, since a movable panel in conformance with the present invention and bearing dress portion 54 has been inserted into the rear of enclosure 22. A doll is not shown in FIG. 2, however, the elements for emplacement of a doll are shown, namely rotatable pedestal 56 from which clamps 58 extend upwards to receive the legs of a doll. FIG. 2 also shows the semi-circular section 60 of a lower hollow planar platform which extends under the pedestal 56, and which also extends under the enclosure 22 below the transparent panel 50 and the movable panel which bears an identity portion, i.e. dress 54. Section 60 is provided with an arcuate slit 62 to accommodate the manipulation, i.e. semi-circular movement, of a handle 64 which extends upwards from attachment to an extension 66 at the perimeter of a circular driving member to be described infra.

Figure 3:
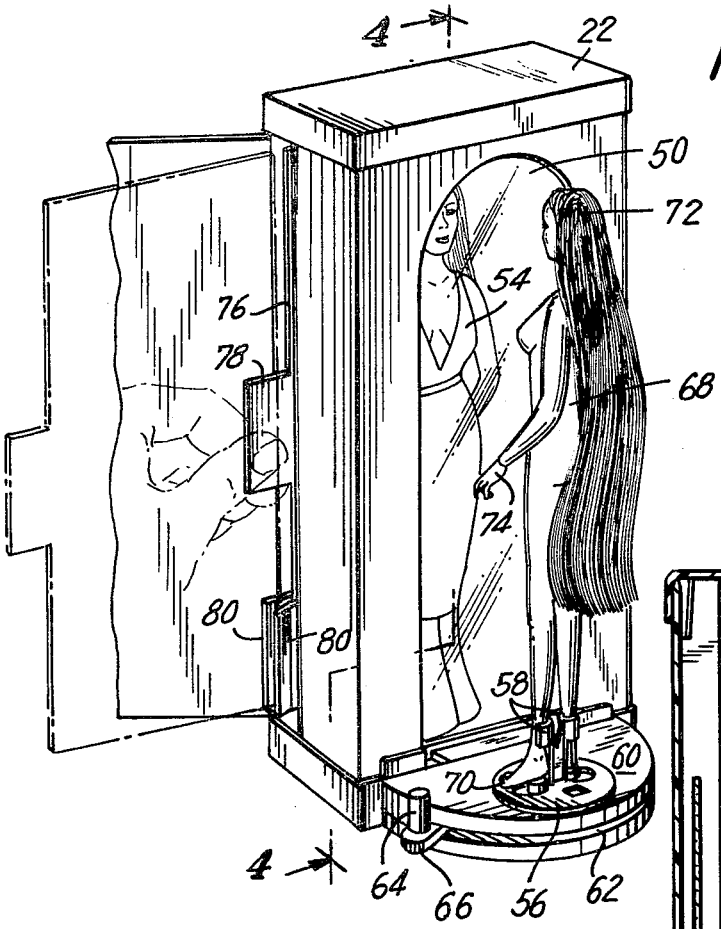
FIG. 3 shows the enclosure portion of the toy dressing room with doll and movable panel emplaced.
Figure 4:
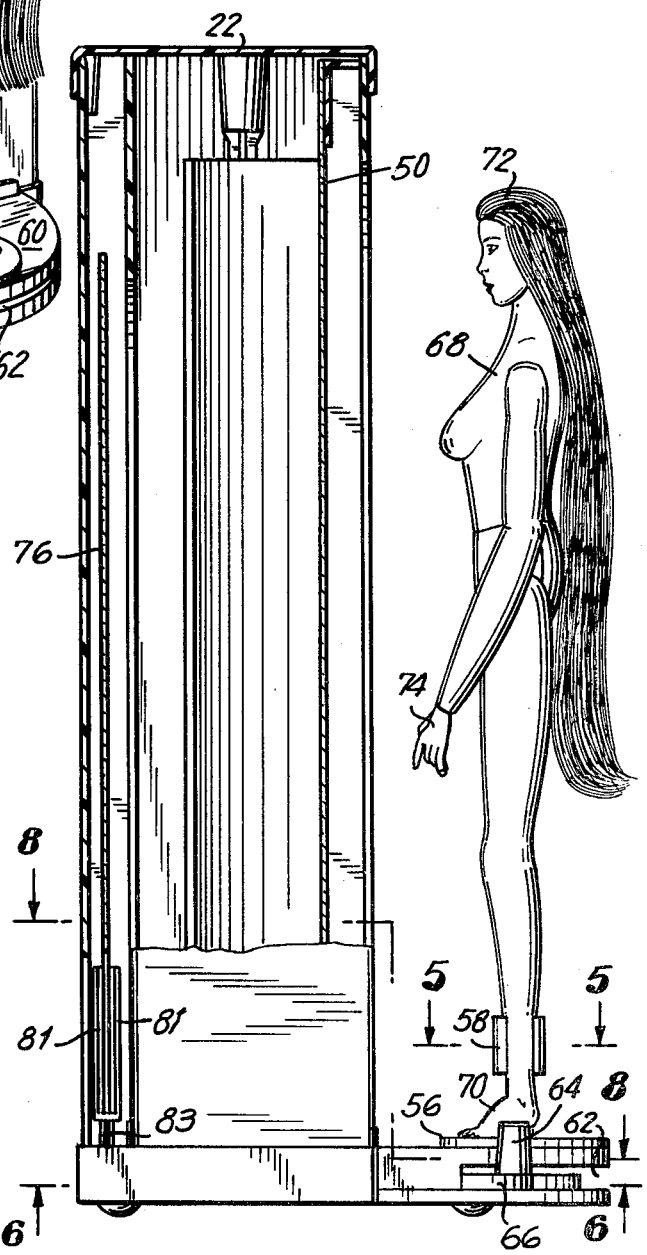
FIG. 4 is a sectional elevation view taken substantially along the line 4—4 of FIG. 3.
Figure 5:
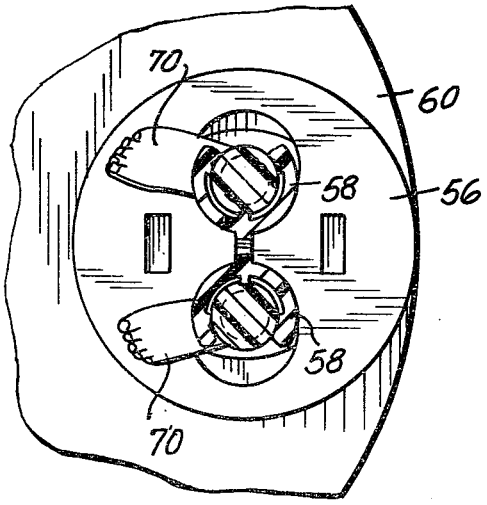
FIG. 5 is a sectional plan view taken substantially along the line 5—5 of FIG. 4.

Referring now to FIGS. 3–8 inclusive, details of the enclosure appurtenances and a doll mounted in position for viewing in conjunction with identity portion 54 are shown. A doll 68 is mounted on the pedestal 56 via leg clamps 58 with the feet 70 of the doll 68 showing below the clamps 58. The doll 68 is dressed in a full-length preferably black leotard, so that only the head 72, hands 74 and feet 70 are uncovered. The doll 68 is shown facing the transparent panel 50 so that as best shown in FIG. 3, a child looking into the enclosure 22 and viewing the transparent panel 50 sees a reflected image of the doll coincident with the identity portion (dress) 54, so that the doll 68 appears to be dressed in the dress 54 as seen in the enclosure. FIG. 3 shows, in phantom outline, the manual emplacement of a movable panel 76 within the enclosure 22 by means of a tab 78. The movable panel 76 is inserted between lower guiding tabs 80 which define the inlet of a lower channel 81 on which the movable panel 76 is mounted (FIG. 4). The channel 81 is supported on movable mount frame 83.

Figure 6:
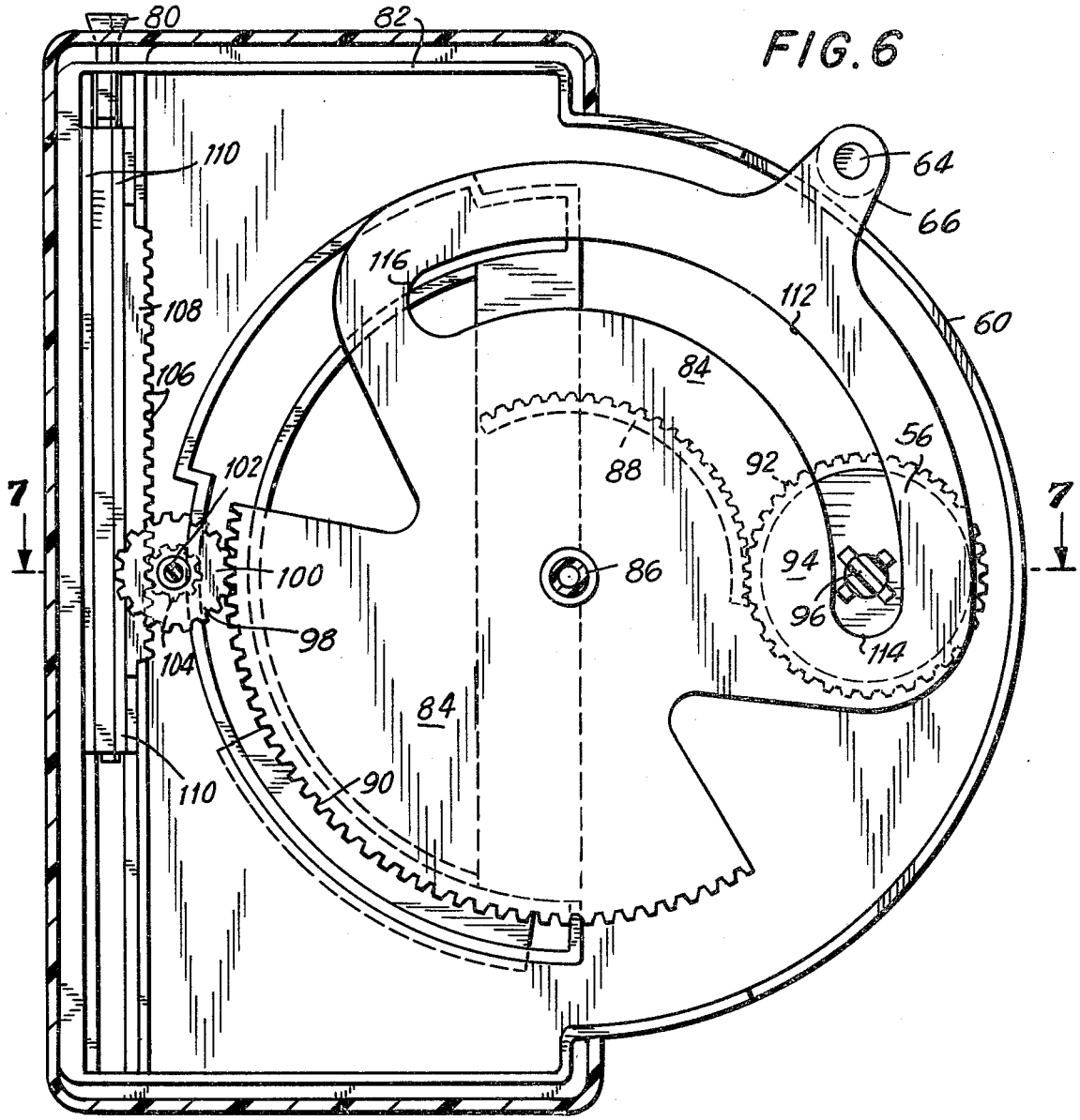
FIG. 6 is a bottom sectional view taken substantially along the line 6—6 of FIG. 4.
Figure 7:
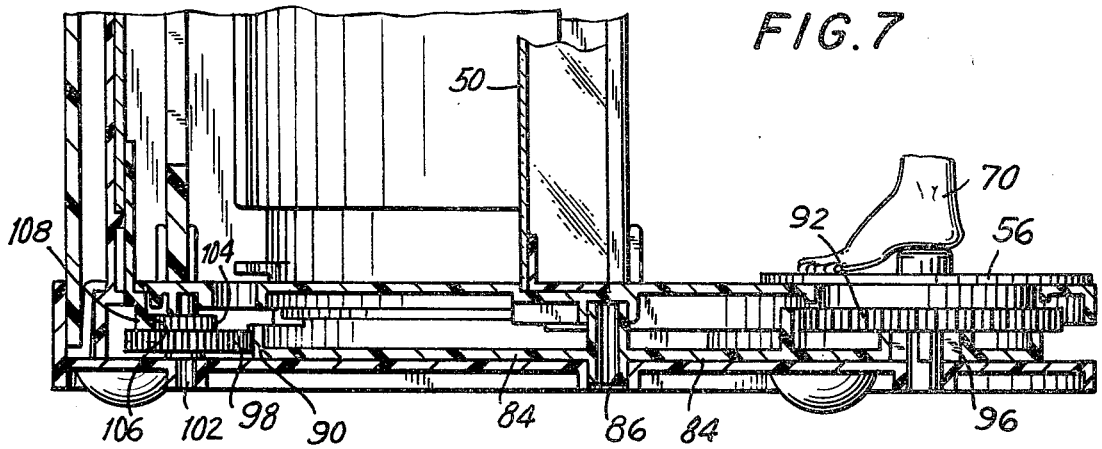
FIG. 7 is a partial sectional elevation view taken substantially along the line 7—7 of FIG. 6.
Figure 8:
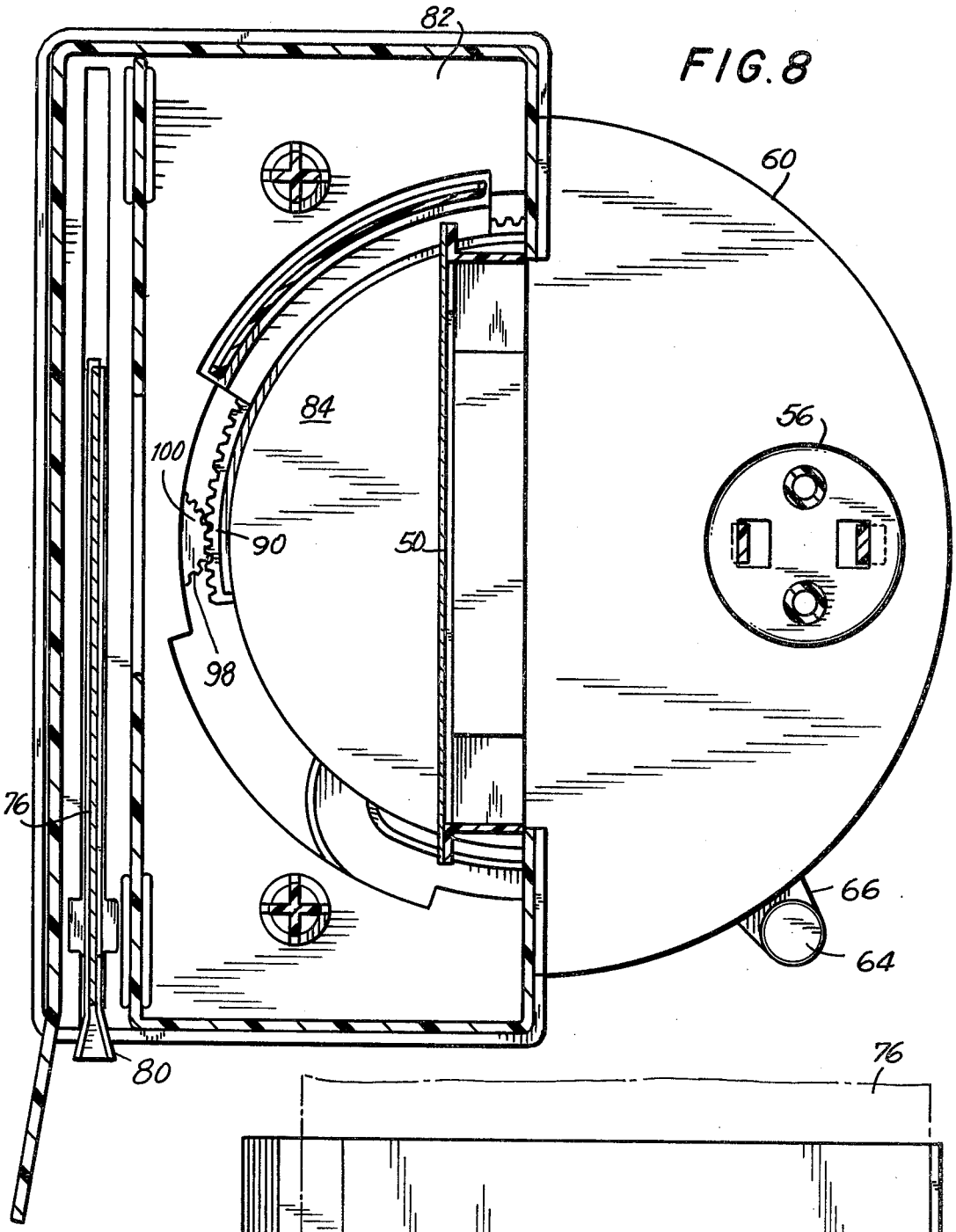
FIG. 8 is a two-part sectional plan view taken substantially along the line 8—8 of FIG. 4.

Referring to FIGS. 6, 7 and 8, internals of the hollow planar platform are shown. The platform consists basically of section 60 and its associated rectangular section 82. As best shown in FIG. 6 a substantially circular planar driving member 84 is disposed within and in parallel with the platform, in a sandwich-type arrangement. A driving member 84 is centrally pivoted by the provision of the pivotal mounting consisting of central axle 86, which axle 86 is essentially disposed at the center of the diameter of section 60. Thus, as shown FIG. 6, the generally circular driving member 84 is disposed so that half of member 84 is within section 60 and the other half is within section 82. In order to turn the driving member 84 about the central pivot axle 86, handle 64 is grasped by a child and manipulated in a semi-circular path. This manipulation concomitantly accomplishes two things. The drive member 84 is provided with an inner arcuate gearing 88 and an outer perimetral arcuate gearing 90, each of said arcuate gearings 88 and 90 serving to accomplish one of the two concomitant functions attained by the manipulation of lever 64. As best shown in FIG. 6 the gearing 88 is opposite to the gearing 90, i.e. the two gearings are on opposite sides of the driving member 84.

Referring first to the inner arcuate gearing 88, this gearing is geared to, i.e. meshes with, a pedestal rotation gearing 92 which is provided on the outer perimeter of a circular pedestal rotation gearing means 94, which is coaxially attached to a central rotation axle 96 of the pedestal 56, so that movement of gearing 88 causes movement of pedestal rotation gearing means 94, which in turn rotates the pedestal 56 via central rotation axle 96.

Referring now to the gearing 90 of member 84, this gearing 90 cooperates with, i.e. meshes with, outer perimetral gear teeth 98 of pinion gear 100, so that manipulation of handle 64 to turn member 84 causes the pinion gear 100 to rotate about a fixed central axis of axle 102. The pinion gear, in turn, is provided with an inner gearing 104 which meshes with the teeth 106 of a linear rack 108 which is disposed in the rear of the rectangular section 82. The rack 108 serves as a mounting for the movable panel 76, i.e. the rack 108 depends from the frame or bracket means 110 which is the immediate mounting for the movable panel and which serves to move the movable panel 76. Since the inner gearing 104 of the pinion gear 100 is geared, i.e. meshed, with the teeth 106 of linear rack 108, rotation of the gear 100 causes the rack 108 to move linearly in a horizontal direction and thereby to move the movable panel 76.

Figure 9:
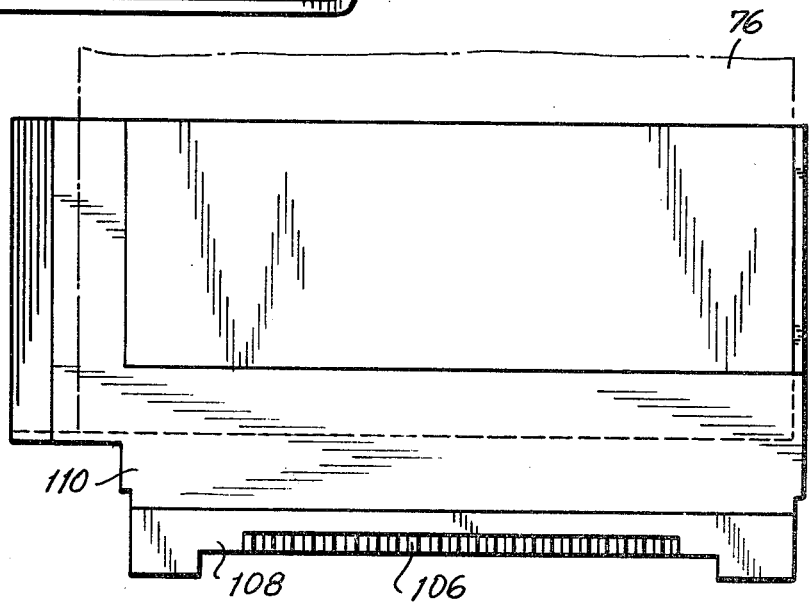
FIG. 9 shows the means for mounting and displacing the movable panel.

FIG. 9 shows the frame 110 mounted on the linear rack 108 and, also shows in phantom outline, a movable panel 76 is place.

Figure 10:
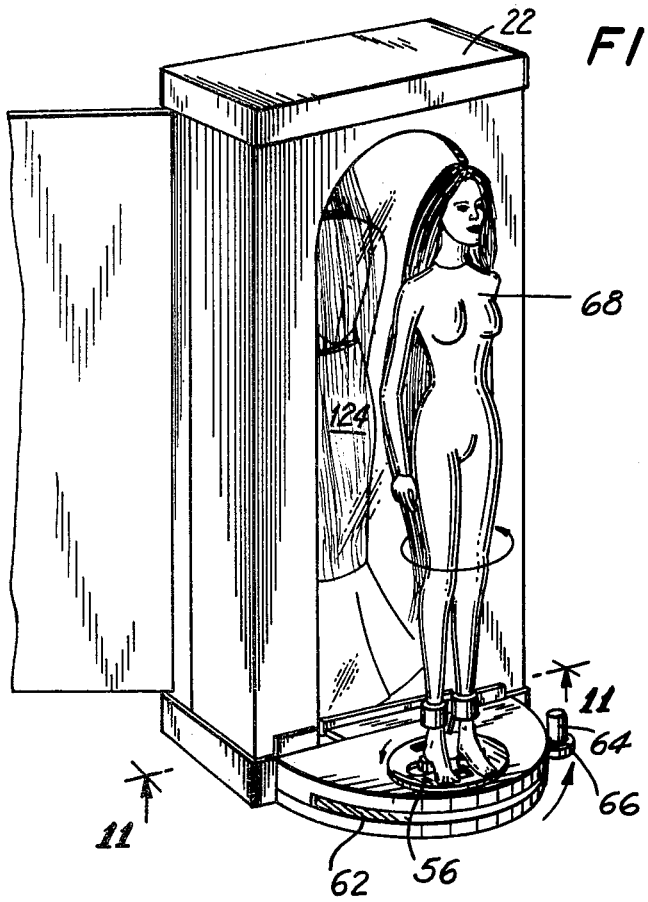
FIG. 10 shows the enclosure with the doll turned by substantially 180 degrees.
Figure 11:
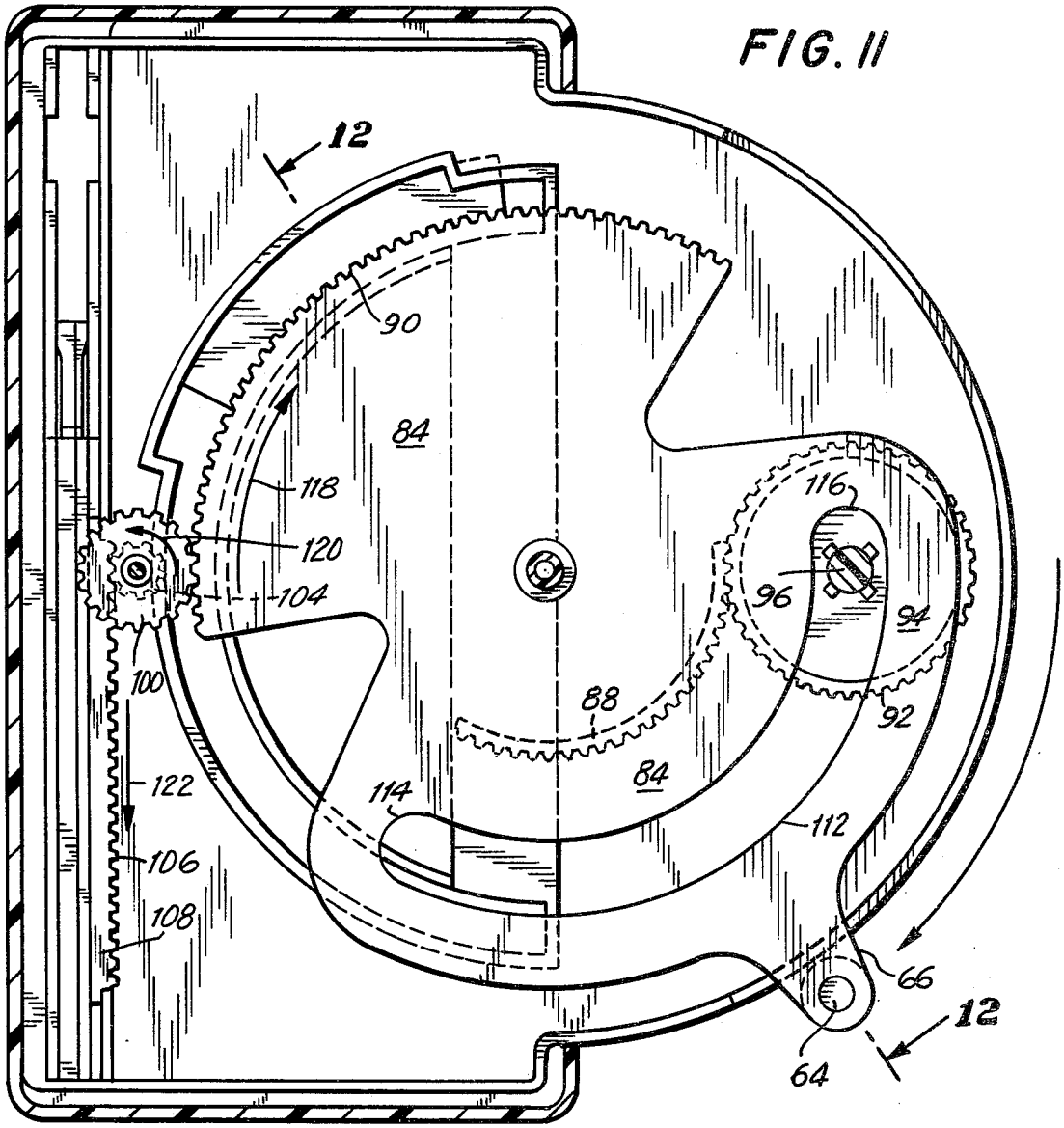
FIG. 11 is a sectional bottom view taken substantially along the line 11—11 of FIG. 10.
Figure 12:
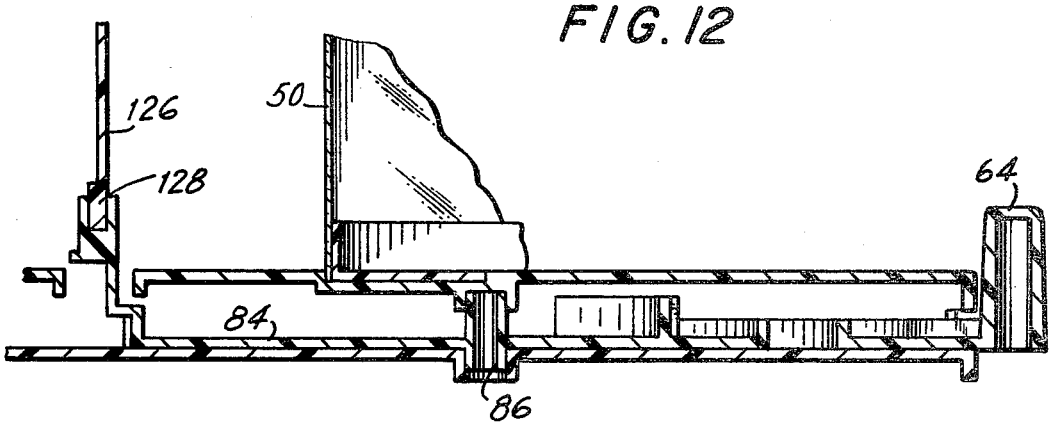
FIG. 12 is a partial sectional elevation view taken substantially along the line 12—12 of FIG. 11.

FIGS. 10, 11 and 12 illustrate the alternative position of the doll, and the alternative view of the back of the doll together with the associated back of the dress, which is attained by manipulation of the handle 64 so as to displace the circular driving member 84 by approximately 180 degrees. At the onset, accommodation for the presence of the central rotation axle 96 of the pedestal rotation gearing means 94 is attained by the provision of an arcuate slit 112 in the circular driving member 84. Thus, comparing FIGS. 6 and 11, the presence of slit 112 has allowed the circular driving member 84 to be moved in FIG. 1 so that the end 114 of the slit 112 is displaced away from member 96 while the opposite end 116 of slit 112 is juxtaposed with member 96. The arrows 118, 120 and 122 indicate respectively the direction of displacement of the respective members 84, 100, and 108. It thus will be seen, comparing FIG. 11 to FIG. 6, that the members 94 and 100 have rotated so as to, respectively, turn the pedestal 56 and its associated doll 68 by 180 degrees, so that, referring to FIG. 10, the image of the back of the doll coincident with the back 124 of the dress appears to be in the enclosure 22. The FIG. 11 shows how, at the same time, rack 108 has been linearly and horizontally displaced so as to bring dress section 124 into view.

FIG. 12 shows a portion of an auxiliary appurtenance which will preferably be provided in practice. This appurtenance 126 consists of a light-absorptive panel which extends upwards and through a curved slit in the rear of the rectangular section of the platform, from attachment 128 to circular driving member 84 at a point adjacent the outer perimetral arcuate gearing 90. Manipulation of the lever 64 causes this light-absorptive panel to pass across the rear of the enclosure 22 and in front of the movable panel 76 upon partial turning of the doll 68, so that the movable panel 76 is only visible when the doll 68 has been completely turned to the alternate position shown in FIG. 10. In other words the panel 126 masks the displacement of the movable panel 76. This light-absorptive panel 126 will preferably be curved and will be black in most instances.

Figure 13:
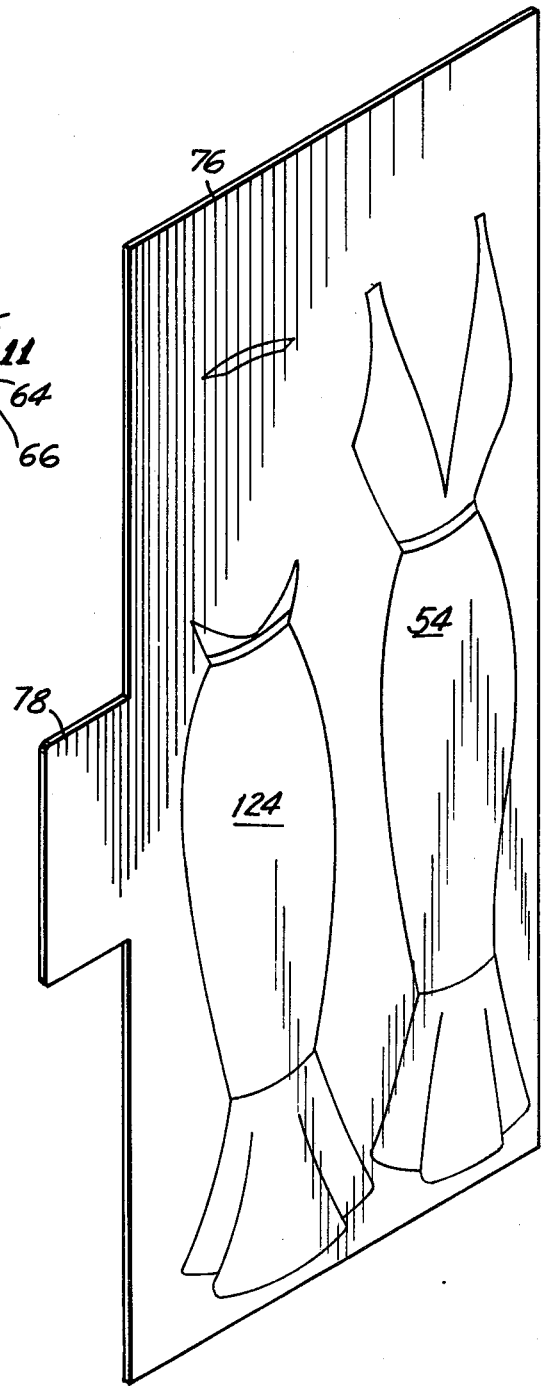
FIG. 13 shows a movable panel with two identity portions relating, respectively, to the front and back of the doll.

FIG. 13 shows the preferred configuration of the movable panel 76, namely with two juxtaposed identity portions 54 and 124 consisting, respectively of the front and back of a dress, which may be an everyday garment, a costume, a uniform, or other suitable identity portions known to the art. Thus for exammple, other simulated identity portions which may appear on movable panel 76 and which are recognizable as identity portions with which a child can relate include a face mask, e.g. of a pirate, a clown, or a known historical figure, a helmet such as a fireman's or soldier's helmet, a distinctive hat or cap such as a sailor's cap, a badge, a tool, a gun or rifle e.g. for a policeman or soldier, a bride's garb including a veil, a nurse's uniform, etc.

It thus will be seen that there is provided a doll with simulated identities which achieves the various objects of the invention and which is adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. In other words, it will be understood by those skilled in the art that, although preferred embodiments have been shown and described in accordance with the Patent Statutes, the invention is not limited thereto or thereby.

It will be appreciated that the recognizable identity portion in general may be a likeness or a picture printed on the movable panel, a photograph, or any other form of illustration of the identity portion known to the art; the recognizable identity portion may even be painted, engraved or lithographed onto the movable panel, either in black and white or in appropriate colors.

Having thus described the invention, there is claimed as new and desired to be secured by Letters Patent:

1. A toy for the concomitant turning motion of a doll and linear motion of a movable panel bearing at least one recognizable portion of the identity of the doll which comprises means to turn the doll about a central longitudinal axis in conjunction with linear motion of the movable panel, said means comprising a hollow planar platform, a centrally pivoted substantially circular planar driving member disposed within and in parallel relation with said platform, said platform having a semicircular section and a rectangular section, the semicircular section of said platform being joined along its diameter to a side of the rectangular section of said platform, said driving member being pivotally mounted within said platform by a central axle, said central axle being disposed substantially at the center of the diameter of the semi-circular section of said platform, said semi-circular section of said platform being provided with an arcuate split, a handle, said handle extending from the perimeter of said driving member through said arcuate slit, so that said driving member within said platform may be turned about said central axle by arcuate manipulation of said handle, the means to mount the doll comprising a pedestal, said pedestal being mounted on said semi-circular section of said platform by a central rotation axle, said central rotation axle extending through said platform, a circular pedestal rotation gearing means, said pedestal rotation gearing means being coaxially attached to said central rotation axle within said platform, said circular driving member having an inner arcuate gearing and an outer perimetral arcuate gearing, said inner arcuate gearing being opposite to said outer perimetral arcuate gearing and being geared to said pedestal rotation gearing means, so that manipulation of said handle causes said pedestal to rotate about its central rotation axle, a pinion gear, said outer perimetral arcuate gearing being geared to outer perimetral gear teeth of said pinion gear so that manipulation of said handle causes said pinion gear to rotate about a fixed central axis, said pinion gear having an inner gearing, a linear rack, said rack being disposed in the rear of said rectangular section of said platform, said rack depending from the means to move the movable panel, the inner gearing of said pinion gear being geared to said rack, so that rotation of said pinion gear causes said rack to move linearly and thereby to move the movable panel.

2. The toy of claim 1 in which the pedestal is provided with at least one clamp to hold a leg of the doll.

3. A doll with a simulated identity combined with an accessory therefor, said combination comprising a transparent panel, said transparent panel being both light transmissive and light reflective, a doll, means to mount said doll in front of said transparent panel, said transparent panel defining the front of an enclosure, a movable panel, said movable panel having a surface with portions thereof bearing at least two recognizable portions of the identity of a doll, one of said at least two recognizable identity portions relating to the front of the doll and another of said at least two recognizable identity portions relating to the back of the doll, the balance of the surface of said movable panel adjacent said identity portions being light absorptive, and means to pass said movable panel into the rear of said enclosure to a position such that said movable panel is disposed substantially parallel to and spaced from said transparent panel in the rear of said enclosure, the balance of the interior of said enclosure being light-absorptive, said doll being placed in said mounting means in front of said transparent panel and spaced therefrom by a distance substantially equal to the distance between said transparent panel and said position of said movable panel so that the image of said doll reflected from said transparent panel appears to be coincident with said identity portion of said movable panel within said enclosure, and means whereby, when mounted, said doll is turnable about a central longitudinal axis in conjunction with linear motion of the movable panel parallel to the transparent panel, so that the reflected image of the doll together with a corresponding recognizable identity portion may alternately appear to be viewed in the enclosure in simulated front and back views.

4. The combination of claim 3 in which the arms, legs and body of the doll are provided with a light-absorptive surface so that only the head, hands and feet of the doll are reflected from the transparent panel.

5. The combination of claim 3 in which one of the recognizable identity portion is ans article of clothing.

6. The combination of claim 3 in which the enclosure is a portion of a toy dressing room.

7. The combination of claim 3 said means to turn the doll comprising a hollow planar platform, a centrally pivoted substantially circular planar driving member disposed within and in parallel relation with said platform, said platform having a semi-circular section and a rectangular section, the semi-circular section of said platform being joined along its diameter to a side of the rectangular section of said platform, said driving member being pivotally mounted within said platform by a central axle, said central axle being disposed substantially at the center of the diameter of the semi-circular section of said platform, said semi-circular section of said platform being provided with an arcuate slit, a handle, said handle extending from the perimeter of said driving member through said arcuate slit, so that said driving member within said platform may be turned about said central axle by arcuate manipulation of said handle, the means to mount the doll in front of the transparent panel comprising a pedestal, said pedestal being mounted on said semi-circular section of said platform by a central rotation axle, said central rotation axle extending through said platform, a circular pedestal rotation gearing means, said pedestal rotation gearing means being coaxially attached to said central rotation axle within said platform, said circular driving member having an inner arcuate gearing and an outer perimetral arcuate gearing, said inner arcuate being opposite to said outer perimetral arcuate gearing and being geared to said pedestal rotation gearing means, so that manipulation of said handle causes said pedestal to rotate about its central rotation axle, a pinion gear, said outer perimetral arcuate gearing being geared to outer perimetral gear teeth of said pinion gears so that manipulation of said handle causes said pinion gear to rotate about a fixed central axis, said pinion gear having an inner gearing, a linear rack, said rack being disposed in the rear of said rectangular section of said platform, said rack depending from the means to pass the movable panel into the rear of the enclosure, the inner gearing of said pinion gear being geared to said rack, so that rotation of said pinion gear causes said rack to move linearly under the rear of the enclosure and thereby to pass the movable panel across the rear of the enclosure.

8. The combination of claim 7 in which the pedestal is provided with at least one clamp to hold a leg of the doll.

9. The combination of claim 7 in which a light-absorptive panel extends upwards and through a curved slit in the rear of the rectangular section of said platform, from attachment to the circular driving member adjacent the outer primetral acruate gearing of the circular driving member, so that manipulation of the handle causes said light-absorptive panel to pass across the rear of the enclosure and in front of the movable panel upon partial turning of the doll, so that the movable panel is only visible when the doll has been completely turned to an alternate position.

10. The combination of claim 9 in which the light-absorptive panel is curved.

11. The combination of claim 9 in which the light-absorptive panel is black.

* * * * *